US008456493B2

(12) United States Patent
Xu et al.

(10) Patent No.: US 8,456,493 B2
(45) Date of Patent: Jun. 4, 2013

(54) METHOD FOR DRIVING MATRIX DISPLAYS

(75) Inventors: Chihao Xu, Saarbrücken (DE); Jürgen Wahl, Bad Soden (DE); Friedrich Eisenbrand, Uchtelfangen (DE); Andreas Karrenbauer, Saarbrücken (DE); Kian Min Soh, Saarbrücken (DE); Christoph Hitzelberger, Saarlouis (DE)

(73) Assignees: Universitat des Saarlandes, Saarbrucken (DE); Kyocera Display Europe GmbH, Babenhausen (DE); Max-Planck-Gesellschaft zur Forderung der Wissenschaften E.V., Munich (DE)

( * ) Notice: Subject to any disclaimer, the term of this patent is extended or adjusted under 35 U.S.C. 154(b) by 816 days.

(21) Appl. No.: 12/163,083

(22) Filed: Jun. 27, 2008

(65) Prior Publication Data

US 2009/0195563 A1 Aug. 6, 2009

Related U.S. Application Data

(63) Continuation of application No. PCT/EP2006/012362, filed on Dec. 21, 2006.

(30) Foreign Application Priority Data

Dec. 30, 2005 (DE) ..... 10 2005 063 159

(51) Int. Cl.
*G09G 5/10* (2006.01)

(52) U.S. Cl.
USPC ..... 345/690; 345/691

(58) Field of Classification Search
USPC ..... 345/690, 691
See application file for complete search history.

(56) References Cited

U.S. PATENT DOCUMENTS

| | | | | |
|---|---|---|---|---|
| 2004/0150660 | A1 * | 8/2004 | Abe et al. | 345/691 |
| 2007/0085779 | A1 * | 4/2007 | Smith et al. | 345/76 |

FOREIGN PATENT DOCUMENTS

| | | |
|---|---|---|
| DE | 197 44 793 Al | 10/1997 |
| EP | 1 437704 A2 | 7/2004 |
| JP | 2001337649 | 12/2001 |
| WO | WO 97/16811 | 5/1997 |
| WO | WO 03/091983 | 11/2003 |
| WO | WO 2006/035246 | 4/2006 |
| WO | WO 2006/035248 | 4/2006 |
| WO | WO 2007/023251 | 3/2007 |

OTHER PUBLICATIONS

Friedrich Eisenbrand, et al., "Multiline Addressing by Network Flow," Algorithms-ESA 2006 Lecture Notes in Computer Sciences; LNCS.

Information Sheet "Clare Micronix—MXED—301," Jan. 22, 2002.

Translation of the International Preliminary Report on Patentability corresponding to International Application Serial No. PCT/EP2006/012362, mailed Oct. 9, 2008, 7 pages.

* cited by examiner

*Primary Examiner* — Amr Awad
*Assistant Examiner* — Randal Willis
(74) *Attorney, Agent, or Firm* — McAndrews, Held & Malloy, Ltd.

(57) ABSTRACT

A method is described for driving matrix displays which are made up of a plurality of lines with individual pixels, which lines are configured as rows and columns, wherein individual lines are driven selectively by rows being activated for a defined row addressing time and an operating current or a corresponding voltage being applied to the columns in correlation with the activated row corresponding to the desired brightness in the pixels. In order to improve the performance of the display, the row addressing time for each row is determined as a function of the maximum brightness of all the columns of the row.

17 Claims, 12 Drawing Sheets

FIG. 1a
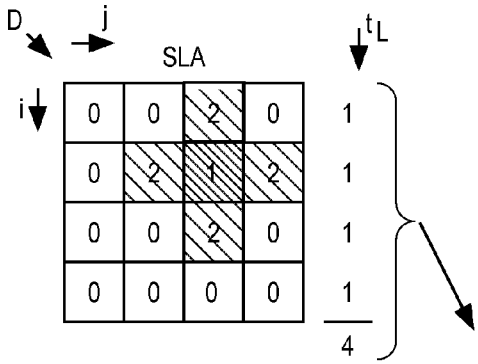
FIG. 1b
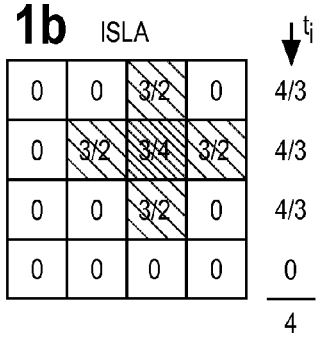
FIG. 1c
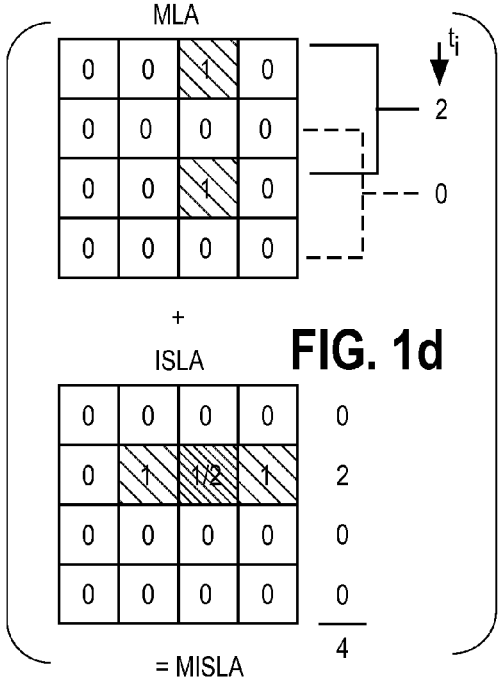
FIG. 1d
FIG. 2a
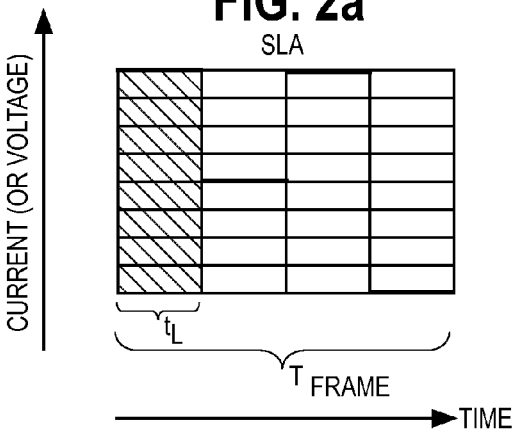
FIG. 2c
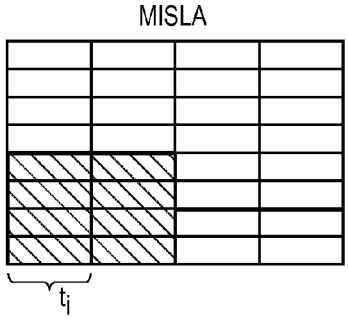
(Pulse for Pixel (ij=1,3) or Pixel (ij=3,3) in Fig. 1)
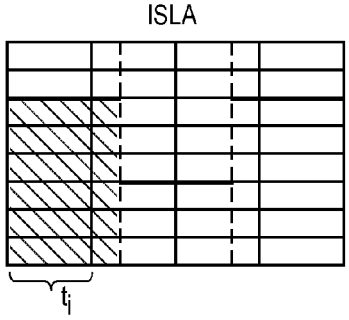
FIG. 2b FIG. 3a
$$D = \begin{pmatrix} 5 & 6 & 5 \\ 1 & 1 & 1 \\ 6 & 5 & 6 \\ 1 & 0 & 1 \\ 5 & 6 & 5 \end{pmatrix} \begin{matrix} \text{BRIGHT} \\ \text{DARK} \\ \text{BRIGHT} \\ \text{DARK} \\ \text{BRIGHT} \end{matrix}$$
FIG. 3b
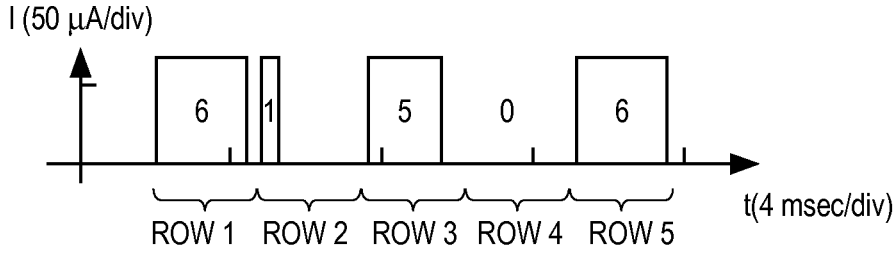
FIG. 3c
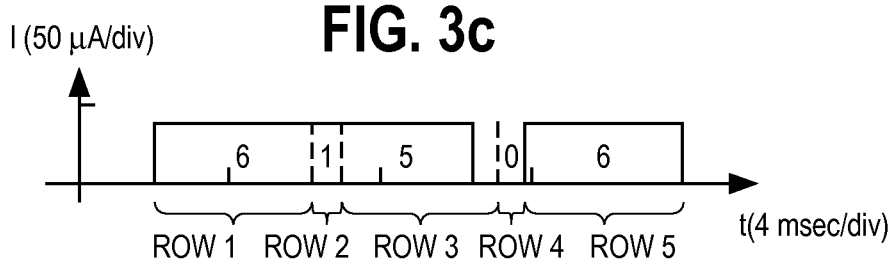

FIG. 5

$$S = \begin{pmatrix} S_{11} & S_{12} & \dots & S_{1m} \\ S_{21} & S_{22} & \dots & S_{2m} \\ . & . & \dots & . \\ S_{n1} & S_{n2} & \dots & S_{nm} \end{pmatrix}$$

$$M2 = \begin{pmatrix} M2_{11} & M2_{12} & \dots & M2_{1m} \\ M2_{11} & M2_{12} & \dots & M2_{1m} \\ 0 & 0 & 0 & 0 \\ 0 & 0 & 0 & 0 \\ 0 & 0 & 0 & 0 \end{pmatrix} + \begin{pmatrix} 0 & 0 & 0 & 0 \\ M2_{21} & M2_{22} & \dots & M2_{2m} \\ M2_{21} & M2_{22} & \dots & M2_{2m} \\ 0 & 0 & 0 & 0 \\ 0 & 0 & 0 & 0 \end{pmatrix} + \dots + \begin{pmatrix} 0 & 0 & 0 & 0 \\ 0 & 0 & 0 & 0 \\ 0 & 0 & 0 & 0 \\ M2_{n-1,1} & M2_{n-1,2} & \dots & M2_{n-1,m} \\ M2_{n-1,1} & M2_{n-1,2} & \dots & M2_{n-1,m} \end{pmatrix}$$

$$= \begin{pmatrix} M2_{11} & M2_{12} & \dots & M2_{1m} \\ M2_{11} + M2_{21} & M2_{12} + M2_{22} & \dots & M2_{1m} + M2_{2m} \\ . & . & \dots & . \\ M2_{n-2,1} + M2_{n-1,1} & M2_{n-2,2} + M2_{n-1,2} & \dots & M2_{n-2m} + M2_{n-1,m} \\ M2_{n-1,1} & M2_{n-1,2} & \dots & M2_{n-1,m} \end{pmatrix}$$

$$M3 = \begin{pmatrix} M3_{11} & M3_{12} & \dots & M3_{1m} \\ M3_{11} & M3_{12} & \dots & M3_{1m} \\ M3_{11} & M3_{12} & \dots & M3_{1m} \\ 0 & 0 & 0 & 0 \\ 0 & 0 & 0 & 0 \end{pmatrix} + \begin{pmatrix} 0 & 0 & 0 & 0 \\ M3_{21} & M3_{22} & \dots & M3_{2m} \\ M3_{21} & M3_{22} & \dots & M3_{2m} \\ M3_{21} & M3_{22} & \dots & M3_{2m} \\ 0 & 0 & 0 & 0 \end{pmatrix} + \dots + \begin{pmatrix} 0 & 0 & 0 & 0 \\ 0 & 0 & 0 & 0 \\ M3_{n-2,1} & M3_{n-2,2} & \dots & M3_{n-2,m} \\ M3_{n-2,1} & M3_{n-2,2} & \dots & M3_{n-2,m} \\ M3_{n-2,1} & M3_{n-2,2} & \dots & M3_{n-2,m} \end{pmatrix}$$

FIG. 6

$$D = M2 + S$$

$$D = \begin{pmatrix} 7 & 13 & 5 & 9 \\ 11 & 11 & 9 & 6 \\ 7 & 5 & 13 & 5 \\ 3 & 0 & 11 & 2 \\ 3 & 3 & 9 & 3 \\ 5 & 7 & 15 & 4 \\ 9 & 11 & 11 & 7 \\ 11 & 9 & 7 & 8 \\ 2 & 7 & 6 & 13 \end{pmatrix} = \begin{pmatrix} 7 & 8 & 5 & 5 \\ 11 & 11 & 9 & 6 \\ 6 & 3 & 10 & 2 \\ 3 & 0 & 11 & 2 \\ 1 & 0 & 9 & 1 \\ 5 & 6 & 14 & 3 \\ 9 & 10 & 10 & 6 \\ 6 & 8 & 5 & 8 \\ 2 & 4 & 5 & 5 \end{pmatrix} + \begin{pmatrix} 0 & 5 & 0 & 4 \\ 0 & 0 & 0 & 0 \\ 1 & 2 & 3 & 3 \\ 0 & 0 & 0 & 0 \\ 2 & 3 & 0 & 2 \\ 0 & 1 & 1 & 1 \\ 0 & 1 & 1 & 1 \\ 5 & 1 & 2 & 0 \\ 0 & 3 & 1 & 8 \end{pmatrix}$$

$$M2 = \begin{pmatrix} 7 & 8 & 5 & 5 \\ 11 & 11 & 9 & 6 \\ 6 & 3 & 10 & 2 \\ 3 & 0 & 11 & 2 \\ 1 & 0 & 9 & 1 \\ 5 & 6 & 14 & 3 \\ 9 & 10 & 10 & 6 \\ 6 & 8 & 5 & 8 \\ 2 & 4 & 5 & 5 \end{pmatrix} = \begin{pmatrix} 7 & 8 & 5 & 5 \\ 7+4 & 8+3 & 5+4 & 5+1 \\ 4+2 & 3+0 & 4+6 & 1+1 \\ 2+1 & 0+0 & 6+5 & 1+1 \\ 1+0 & 0+0 & 5+4 & 1+0 \\ 0+5 & 0+6 & 4+10 & 0+3 \\ 5+4 & 6+4 & 10+0 & 3+3 \\ 4+2 & 4+4 & 0+5 & 3+5 \\ 2 & 4 & 5 & 5 \end{pmatrix}$$

FIG. 7

$$D = M3 + M2 + S$$

$$D = \begin{pmatrix} 7 & 13 & 5 & 9 \\ 11 & 11 & 9 & 6 \\ 7 & 5 & 13 & 5 \\ 3 & 0 & 11 & 2 \\ 3 & 3 & 9 & 3 \\ 5 & 7 & 15 & 4 \\ 9 & 11 & 11 & 7 \\ 11 & 9 & 7 & 8 \\ 2 & 7 & 6 & 13 \end{pmatrix} = \begin{pmatrix} 4 & 4 & 5 & 5 \\ 6 & 4 & 8 & 5 \\ 6 & 4 & 9 & 5 \\ 2 & 0 & 8 & 2 \\ 0 & 1 & 7 & 3 \\ 5 & 5 & 11 & 3 \\ 7 & 8 & 8 & 6 \\ 7 & 7 & 6 & 5 \\ 2 & 3 & 1 & 5 \end{pmatrix} + \begin{pmatrix} 3 & 5 & 0 & 1 \\ 4 & 6 & 1 & 1 \\ 1 & 1 & 3 & 0 \\ 1 & 0 & 3 & 0 \\ 1 & 0 & 1 & 0 \\ 0 & 1 & 3 & 1 \\ 2 & 3 & 3 & 1 \\ 2 & 2 & 1 & 3 \\ 0 & 0 & 1 & 3 \end{pmatrix} + \begin{pmatrix} 0 & 4 & 0 & 3 \\ 1 & 1 & 0 & 0 \\ 0 & 0 & 1 & 0 \\ 0 & 0 & 0 & 0 \\ 2 & 2 & 1 & 0 \\ 0 & 1 & 1 & 0 \\ 0 & 0 & 0 & 0 \\ 2 & 0 & 0 & 0 \\ 0 & 4 & 4 & 5 \end{pmatrix}$$

FIG. 9

$$d' = \begin{pmatrix} D_{11} & D_{12} & \dots & D_{1m} \\ D_{21} - D_{11} & D_{22} - D_{13} & \dots & D_{2m} - D_{1m} \\ & & \dots & \\ D_{n1} - D_{n-1,1} & D_{n2} - D_{n-1,2} & \dots & D_{nm} - D_{n-1,m} \\ -D_{n1} & -D_{n2} & \dots & -D_{nm} \end{pmatrix}$$

$$M2' = \begin{pmatrix} M2_{11} & M2_{12} & \dots & M2_{1m} \\ 0 & 0 & 0 & 0 \\ -M2_{11} & -M2_{12} & \dots & -M2_{1m} \\ 0 & 0 & 0 & 0 \\ 0 & 0 & 0 & 0 \end{pmatrix} + \begin{pmatrix} 0 & 0 & 0 & 0 \\ M2_{21} & M2_{22} & \dots & M2_{2m} \\ 0 & 0 & 0 & 0 \\ -M2_{21} & -M2_{22} & \dots & -M2_{2m} \\ 0 & 0 & 0 & 0 \end{pmatrix}$$

$$+ \dots + \begin{pmatrix} 0 & 0 & 0 & 0 \\ 0 & 0 & 0 & 0 \\ M2_{n-1,1} & M2_{n-1,2} & \dots & M2_{n-1,m} \\ 0 & 0 & 0 & 0 \\ -M2_{n-1,1} & -M2_{n-1,2} & \dots & -M2_{n-1,m} \end{pmatrix} \quad M3' = \begin{pmatrix} M3_{11} & M3_{12} & \dots & M3_{1m} \\ 0 & 0 & 0 & 0 \\ 0 & 0 & 0 & 0 \\ -M3_{11} & -M3_{12} & \dots & -M3_{1m} \\ 0 & 0 & 0 & 0 \\ 0 & 0 & 0 & 0 \end{pmatrix}$$

$$+ \begin{pmatrix} 0 & 0 & 0 & 0 \\ M3_{21} & M3_{22} & \dots & M3_{2m} \\ 0 & 0 & 0 & 0 \\ 0 & 0 & 0 & 0 \\ -M3_{21} & -M3_{22} & \dots & -M3_{2m} \\ 0 & 0 & 0 & 0 \end{pmatrix} + \dots + \begin{pmatrix} 0 & 0 & 0 & 0 \\ 0 & 0 & 0 & 0 \\ M3_{n-2,1} & M3_{n-2,2} & \dots & M3_{n-2,m} \\ 0 & 0 & 0 & 0 \\ 0 & 0 & 0 & 0 \\ -M3_{n-2,1} & -M3_{n-2,2} & \dots & -M3_{n-2,m} \end{pmatrix}$$

$$d' = \begin{pmatrix} 7 & 13 & 5 & 9 \\ 4 & -2 & 4 & -3 \\ -4 & -6 & 4 & -1 \\ -4 & -5 & -2 & -3 \\ 0 & 3 & -2 & 1 \\ 0 & 4 & 6 & 1 \\ 4 & 4 & -4 & 3 \\ 2 & -2 & -4 & 1 \\ -9 & -2 & -1 & 5 \\ -2 & -7 & -6 & -13 \end{pmatrix}$$

FIG. 14
```
Input: b
Output: f
f = 0 ∀ a∈A
u = Initialize(b)
H = ∅
while( f is not feasible){
        f = MaxFlow(V, A, b, u)
        C = MinCut(V, A, b, u)
        f or (k = 1,...,p){
            u(k) = u(k) + Δu(k, C, H)
        }
        H ← H ∪ {C}
}
return f
```
FIG. 15
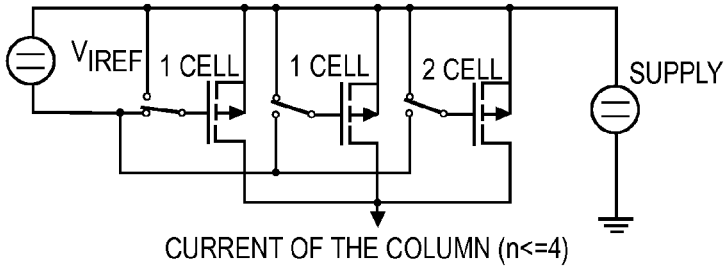
FIG. 16
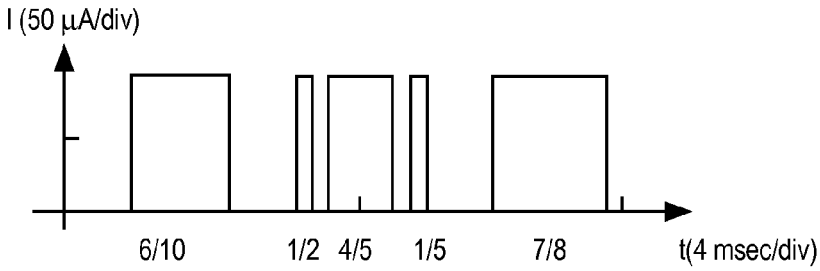
FIG. 17
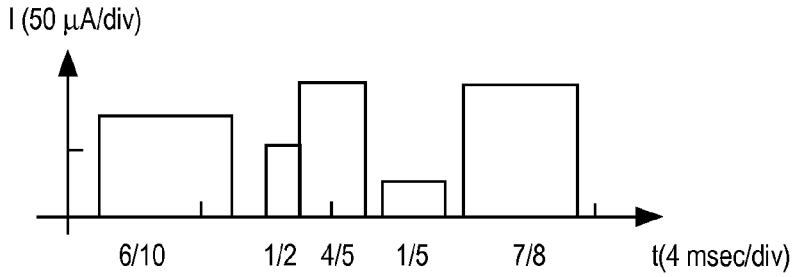

FIG. 18 if ($M_{ij} \leq 1/4 \times M_{i,max}$) then $M_{ij} = 4 \times M_{ij}$ $I = I_1$ elseif ($M_{ij} \leq 1/2 \times M_{i,max}$) then $M_{ij} = 2 \times M_{ij}$ $I = 2 \times I_1$ elseif ($M_{ij} \leq 3/4 \times M_{i,max}$)

then$M_{ij} = 4/3 \times M_{ij}$ else $M_{ij} = M_{ij}$ $I = 4 \times I_1$ endif

METHOD FOR DRIVING MATRIX DISPLAYS

RELATED APPLICATIONS

This application is a continuation of International Application No. PCT/EP2006/012362 (International Publication Number WO/2007/079947), having an International filing date of Dec. 21, 2006 entitled "Verfahren Zur Ansteuerung Von Matrixanzeigen" ("Method For Triggering Matrix Displays"). International Application No. PCT/EP2006/012362 claimed priority benefits, in turn, from German Patent Application No. 10 2005 063 159.2, filed Dec. 30, 2005. International Application No. PCT/EP2006/012362 and German Application No. 10 2005 063 159.2 are hereby incorporated by reference herein in their entireties.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The presently described technology relates to a method for driving matrix displays which are made up of a plurality of lines with individual pixels, which lines are configured as rows and columns, wherein individual lines are driven selectively by rows being activated for a defined row addressing time and an operating current or a corresponding voltage i.e. an electrical driving signal being applied to the columns in correlation with the activated row corresponding to the desired brightness in the pixels.

In the following text, the horizontal lines are referred to as rows and the vertical lines which run orthogonally to them are referred to as columns. This is for reasons of clarity. The invention is however not limited to exactly this arrangement. It is in particular possible to exchange the function of the rows and columns or select a non-orthogonal relationship between the rows and columns.

The image data or the desired brightness $D_{ij}$ of individual pixels ij are described with the matrix D shown below.

$$D = \begin{pmatrix} D_{11} & D_{12} & \dots & D_{1m} \\ D_{21} & D_{22} & \dots & D_{2m} \\ \dots & \dots & \dots & \dots \\ D_{n1} & D_{n2} & \dots & D_{nm} \end{pmatrix}.$$

The indices correspond to the positions of the pixels on the display, which is given by the matrix or matrix display D. Each row i of the matrix D and each column j on the matrix D correspond in each case to the geometric row and column on the display. A pixel diode or similar element is assigned to each drivable pixel ij of the matrix display D for generating a pixel of a display. The light intensity averaged over time (corresponding to the brightness $D_{ij}$) in each pixel corresponds with the corresponding element in the matrix D. All entries of the matrix D together produce the image to be displayed.

The pixels ij on the matrix display D, of which each can be configured in particular as an OLED (Organic Light Emitting Diode), have been activated so far by row. To this end, the OLEDs on a selected row i are activated by a switch by being connected e.g. to ground. An operating current I is impressed in each of the columns j, which current causes the pixels ij in the intersection of this row i and the columns j to light up. The light intensity L is in the first approximation proportional to charge which is impressed during the active phase (row addressing time) and is recombined radiantly in the OLED pixel. In the event of a relatively high frame rate of the addressing of the display matrix or matrix display D, the human eye perceives the following mean value of the intensity L of the light:

$$L_{Licht} \sim \frac{\int_0^{T_{Frame}} I_{OLED} \cdot dt}{T_{Frame}} \approx \frac{I \cdot \frac{T_{Frame}}{n}}{T_{Frame}} = \frac{I}{n}$$

$T_{Frame}$ is the total time which is necessary for building a complete image if all n rows of the matrix display D are activated once. The operating current $I_{OLED}$ or I or $I_0$ is impressed in each pixel. When amplitude modulation is used for controlling brightness, the operating current is active over the period $T_{Frame}/n$ which corresponds to the row addressing time. With pulse width modulation, the duration of the operating current is shorter, that is $d*T_{Frame}/n$. Here, d is the pulse width modulation duty ratio and lies between zero and one:

$$L_{Licht} \sim d \cdot \frac{I_0}{n}$$

The current $I_0$ is now constant independently of the light intensity of the pixel. The intensity L is adjusted by means of the duty ratio d. A brightness control of this type is simpler and more precise in comparison to amplitude modulation, as the time units in the electronics can be adjusted very precisely and consequently d also. Just a reference current $I_0$ is sufficient for driving all the pixels ij. With amplitude modulation, in contrast, the amplitude must be adapted in each case in correspondence with the desired brightness $D_{ij}$.

By driving all the columns j of in each case only one row i, each diode or each pixel ij can be active only for a maximum of an nth of the total time $T_{Frame}$. In order to achieve a defined average brightness $D_{ij}$, the corresponding operating current must be multiplied by the number n of rows, that is, in contrast to the case in which one pixel would be supplied with operating current over the total time $T_{Frame}$. That is, the higher the number of rows, the higher the pulsed operating current I or $I_0$ must be. The operating current is moreover always high when pulse width modulation is used for adjusting the brightness, even when the pixel ij to be driven is very dark. In this case just the application time of the operating current is very short.

The high operating current can however lead to a significant reduction in the OLED lifetime. In order to achieve the necessary high operating current, the voltage at the OLEDs must also be increased, as a result of which the power consumption increases and the efficiency is reduced. This increased power loss not only discharges the rechargeable or disposable battery more quickly, but also makes the display warmer, as a result of which the lifetime is likewise reduced.

In order nevertheless to realise a large, highly resolving display, an "active matrix" could be used as in LCDs (Liquid Crystal Display), by means of which the operating current is no longer delivered in a pulsed manner but is present as a constant current. Active matrix driving (TFT backplane) however requires significant additional costs for an OLED display.

BRIEF SUMMARY OF THE INVENTION

The object of the present technology is to propose a method for driving matrix displays corresponding to the type mentioned at the start, with which the lifetime of the OLED display can be increased or the performance of any matrix display can be improved.

This object is achieved according to the present technology in that the row addressing time $t_i$ for each row i is determined as a function of the maximum brightness $D^i_{max}$ of all the columns j of the row i. The row addressing time $t_i$ can thereby be selected to be less than or equal to a constant row addressing time $t_L$ which is produced when each row of the matrix display is addressed for so long that a maximum pixel brightness $D_{max}$ could be achieved with the impressed operating current. The row addressing time $t_i$ according to the present technology therefore corresponds to the constant row addressing time $t_L$ multiplied by the ratio of the maximum brightness $D^i_{max}$ of the pixels in all the columns j of the row i to the maximum possible pixel brightness $D_{max}$ in the entire matrix display. The maximum pixel brightness $D_{max}$ is defined as the light intensity (brightness) in one pixel ij, which is achieved when the operating current $I_0$ is applied to the pixel during the constant row addressing time $t_L$. This has the effect that the time sum $T_{Sum}$ of the row addressing times $t_i$ over the number n of all the rows is less than or equal to the total time $T_{Frame}$ for activating all n rows, which activation is given by n×the constant row addressing time $t_L$. If the operating current $I_0$ is constant, the total time for driving the matrix display can therefore be reduced according to the present technology to the time sum $T_{Sum}<T_{Frame}$ of the row addressing times. This makes possible for example a higher frame rate and increases the achievable performance of a matrix display.

Since the light intensity of a pixel ij in the first approximation is proportional to the charge which is impressed in a pixel ij, i.e. is proportional to the product of the row addressing time $t_i$ and the operating current, the dependence of the row addressing time $t_i$ on the maximum brightness over the columns of a row can also be used to reduce the operating current. To this end, the total time $T_{Frame}$ for activating all the rows i can be kept constant so that the sum of the row addressing times $t'_i$ over all rows n corresponds to the total time $T_{Frame}$. The row addressing times $t'_i$ are therefore extended according to this variant of the inventive method, so that their sum is equal to the total time $T_{Frame}$. At the same time the operating current $I_0$ can according to the present technology be reduced by the ratio of the time sum $T_{Sum}$ of the (absolutely necessary) row addressing times $t_i$ of all the rows n to the total time ($T_{Frame}$) for activating all the rows with the constant row addressing time $t_L$ to the operating current $I_1$. The light intensity of the individual pixels does not change because the product of the row addressing time and the operating current $t_i*I_0=t'_i*I_1$ remains constant. In the case of OLEDs, the quantum efficiency η in a lower operating current range is as a rule greater than with a higher operating current. The operating current $I_1$ can therefore be additionally reduced by the ratio of the quantum efficiencies $\eta(I_1)/\eta(I_0)$. For the sake of simplicity, the row addressing time $t'_i$ (which is extended or standardised to $T_{Frame}$) is also referred to as $t'_i$ below.

The adaptation according to the present technology of the row addressing times $t_i$ to the addressing of the diode pixels therefore allows the selective phase (row addressing time) of the individual diode pixels ij of the display D, i.e. the time during which the operating current I is applied to the diode pixel ij, to be considerably extended. The active operating current $I_1$ can be reduced in reverse proportion to the duration of the selected phase. The efficiency of the matrix display D can be increased as a whole and, in particular in the case of OLED displays, the lifetime can be extended. A basic idea of this present technology therefore lies in extending the duration of the operating current by means of a row-dependent shortening or adaptation of the row addressing times. Since the charge is primarily decisive for a defined light intensity, more time for impressing the operating current therefore means a reduced amplitude of the current.

Improved handling and a further reduction in the operating current can be achieved if the matrix display D is decomposed into a plurality of matrices S, M which are driven separately. The superposition of all the matrices then produces the image of the matrix display D in the desired brightness $D_{ij}$ of the respective pixels ij. The total brightness $D_{ij}$ formed from the sum of the individual brightnesses $S_{ij}$, $M_{ij}$ of the plurality of matrices should correspond to the total desired brightness $D_{ij}$ of the matrix display D in the pixel ij. According to the present technology the matrices can be displayed one after the other or nested in each other, preferably in each case using the above-described method row by row and column by column. In the case of a division into two matrices, with one matrix S providing the driving of one row i and one matrix M2 providing a simultaneous driving of two rows i, the rows of the matrices S, M2 can be addressed alternately. For passive matrix display types such as OLED displays or LCD, a source image which is described in the matrix display D can therefore be decomposed into a plurality of image matrices. Each of these obtained matrices is to be well implemented for the display type, for example by means of the multi-line addressing described below, so that the sum of the images is implemented better than in direct driving of the display on the basis of the original matrix D.

As long as it is provided according to the present technology that a plurality of rows i are driven simultaneously, the pixels ij in each column j of the driven rows i have in each case the same signal and the same light intensity. So that the light intensity of a pixel ij corresponds to the light intensity when only one row i is driven, the operating current $I_0$, $I_1$ is increased by the multiple corresponding to the number of simultaneously driven rows, therefore doubled when two rows are driven simultaneously. The simultaneous driving of a plurality of rows is also called "multi-line addressing" (MLA) in differentiation from driving of only one row, which is also referred to as "single-line addressing" (SLA).

When a plurality of rows are driven simultaneously, adjacent rows (i, i+1) can preferably be driven. It is however also possible according to the present technology, for preferably rows i which are separated from each other by a few rows to be driven simultaneously, for example each alternate row. A close proximity between simultaneously driven rows is particularly sensible, because rows of the matrix display D which are adjacent in an image often have a similar brightness distribution.

In order to be able also to produce differences in intensity between the individual rows and/or columns when a plurality of rows are simultaneously driven, a matrix (S) in which one row (i) is driven and one or a plurality of matrices (M2, M3, M4) in which a plurality of rows (i) are driven can according to the present technology be combined with each other. By providing a matrix S with single-line addressing, the desired brightness $D_{ij}$ can be adapted individually for each pixel ij. This matrix S is also called a residual single-line matrix.

According to the present technology, pulse width modulation can be used for controlling the brightness, i.e. for example the operating current I is applied during a row addressing time $t_i$ only for a part of the row addressing time $t_i$ and the operating current I is switched off during the remaining time of the row addressing time $t_i$.

Alternatively, amplitude modulation can also be used for controlling the brightness, i.e. the amplitude of the operating current I is adapted to correspond with the desired brightness $D_{ij}$. According to the present technology, the pulse width modulation and the amplitude modulation can also be combined with each other in order to control the brightness. It is then particularly advantageous if the brightness $D_{ij}$ is predefined in quantised steps, because the amplitude of the operating current can then be reduced in quantised steps while the pulse width duty ratio is increased corresponding to this. This driving can be implemented particularly simply in appliances. This combined method can be used flexibly in particular if the time for applying the operating current I in one column j does not exceed the row addressing time $t_i$ after an increase in the pulse width duty ratio. The decision of combining the amplitude modulation with the pulse width modulation can therefore be made individually depending on the operating current application time necessary for this and the provided row addressing time for each row i and column j of the matrix display D. With combined pulse width and amplitude modulation, the amplitude can therefore be reduced with quantised steps while the pulse width modulation duty ratio is increased in correspondence with this. The quantisation can be implemented with a plurality of transistor cells with which multi-line addressing can also be implemented.

In order to generate the matrices used for driving the matrix pixels, it is proposed according to a preferred embodiment to convert the matrix display into a flow matrix which has vertexes as entries, which correspond to the requirement for brightness or differences in brightness of individual pixels in the respective columns. This can take place with a suitable control system in which the above-described method is implemented and which has suitable processor means to carry out the individual processing steps. A control system of this type also forms the subject matter of the present technology. This conversion allows the matrix decomposition to be carried out with a combinatorial method which is based on the known MaxFlow/MinCut principle. The hardware implementation outlay for combinatorial algorithms of this type is known to be low. Combinatorial algorithms can moreover be processed quickly, so that these algorithms are particularly suitable for controlling a matrix display.

It has proved advantageous if the flow matrix is produced from the difference between two matrices, wherein the first matrix consists of the matrix display and a row with zero entries attached to the end of the matrix display and the second matrix consists of the matrix display and a row with zero entries upstream of the matrix display. With a decomposition of a matrix into multi-line matrices and (residual) single-line matrix, it is critical to conceal optimally the differences in brightness of individual pixels in the column. The flow matrix proposed according to the present technology describes the differences between the pixels in the column and offers the basis or an optimal starting point for the optimisation with a combinatorial method.

In a flow matrix according to the present technology, the vertexes are preferably connected by arrows which are referred to as arcs, to which an allocation is assigned, and which preferably correspond in accordance with their length to the entries of the plurality of separately driven matrices (for example S, M2, M3, M4) into which the matrix display can be decomposed as described above. The matrix decomposition is thereby completely converted into a flow optimisation. The result of the flow optimisation, i.e. the arc allocations is then directly the corresponding matrix elements of the single and multi-line matrices S, M2, M3, M4 etc.

For the flow optimisation, in particular in the case of driving of a passive matrix display, it is advantageous for a capacity or a capacity value to be assigned to each row of the matrices involved (S, M2, M3, M4). The capacity value corresponds to the maximum pixel value of the respective row. The sum of all the capacities should then be minimised.

Whereas the capacity is kept constant and the flow is maximised in the case of known MinCut or MaxFlow methods, in the present method the flow is derived from the source matrix (matrix display D) and thus predefined. The aim of the optimisation is to minimise the sum of all the capacities. Therefore, the capacity is according to the present technology designed to be variable. The capacities are increased according to a strategy described below until all the flows are equalised or balanced. A valid assignment of the arcs is then achieved and the matrix decomposition is completed. It can be assumed that the sum of the capacity values is minimal or very small. The ratio between the theoretical minimum and the sum of the capacity values is referred to as the quality of the optimisation. In order to reduce the number of iterations necessary in increasing the capacity values, an assignment of the arcs can be generated as the start value in an initialisation.

According to the present technology, with each iteration the capacities are selected and increased which constitute a bottleneck which prevents a valid solution. This arc set, also called minimum cut (MinCut), can be used as the selection criterion for the capacities to be increased.

In addition, the information of preceding MinCuts can according to the present technology also be used as a selection criterion, wherein the MinCuts of the last iterations can be weighted. This enables a rapid and efficient solution.

In order to accelerate the iteration, the step size with which the capacity value is increased can be adapted dynamically. It is thereby achieved that fewer iterations must be carried out, without losing much optimisation quality with respect to the smallest step size of "one".

In order to increase calculation speed and reduce the required memory size, the matrix display can be decomposed into a plurality of smaller submatrices and the submatrices can be decomposed separately into flow submatrices. An optimisation of this type is considered a local optimisation, while the matrix decomposition in a single optimisation is considered a global optimisation. Since much fewer iterations are required when optimising relatively small matrices, it is also possible to forward the result of S, M2, M3, M4 etc. row by row directly to the register for the output driver without needing buffer memories for these matrices. The outlay on memory is thereby much lower.

Furthermore, a mixed local and global optimisation can according to the present technology be carried out, wherein one or a few rows of multi-line matrices (M2, M3, M4) and/or residual single-line matrices (S) are obtained from a flow submatrix. This achieves a good compromise between local and global optimisation, that is speed and memory size requirement on the one hand, and optimisation quality on the other. The results are output row by row or submatrix by submatrix so that no memory size is required for storing complete matrices.

Preferred applications of the method are the driving of self-emitting displays, for example OLED displays, or non-self-emitting displays, for example LCDs. A further inventive application of the method, which is not concerned with driving matrix displays, rather relates generally to the readout of matrices, for example sensor matrices in CCD cameras.

Further advantages, features and applications of the present technology can be found in the following description of exemplary embodiments and the drawing. All the features described and/or illustrated pictorially form the subject matter of the present technology, regardless of how they are summarised in the claims or of their references.

BRIEF DESCRIPTION OF SEVERAL VIEWS OF THE DRAWINGS

FIG. 1 shows schematically various embodiments of driving a matrix display according to the present technology in order to explain in a descriptive manner single-line and multi-line addressing;

FIG. 2 shows schematically time diagrams of the operating current (or the associated voltage) for driving the pixels of a column of the matrix display shown in FIG. 1;

FIG. 3 shows a matrix display D consisting of three columns and five rows and the current required for driving a column;

FIG. 5 shows a definition of single and multi-line matrices;

FIG. 6 shows a decomposition according to the present technology of a matrix display D into a two-line matrix and a single-line matrix;

FIG. 7 shows a decomposition according to the present technology of the matrix display D shown in FIG. 6 into a three-line, a two-line and a single-line matrix;

FIG. 9 shows a decomposition of the matrix D into a flow matrix d';

FIG. 14 shows a mathematical flow chart for creating the flow matrix d' and an optimised flow diagram;

FIG. 15 shows an embodiment according to the present technology for generating the operating current;

FIG. 16 shows brightness control by means of pulse width modulation;

FIG. 17 shows brightness control by means of combined amplitude and pulse width modulation; and FIG. 18 shows an algorithm for carrying out brightness control according to FIG. 17.

DETAILED DESCRIPTION OF THE INVENTION

Figure 4:
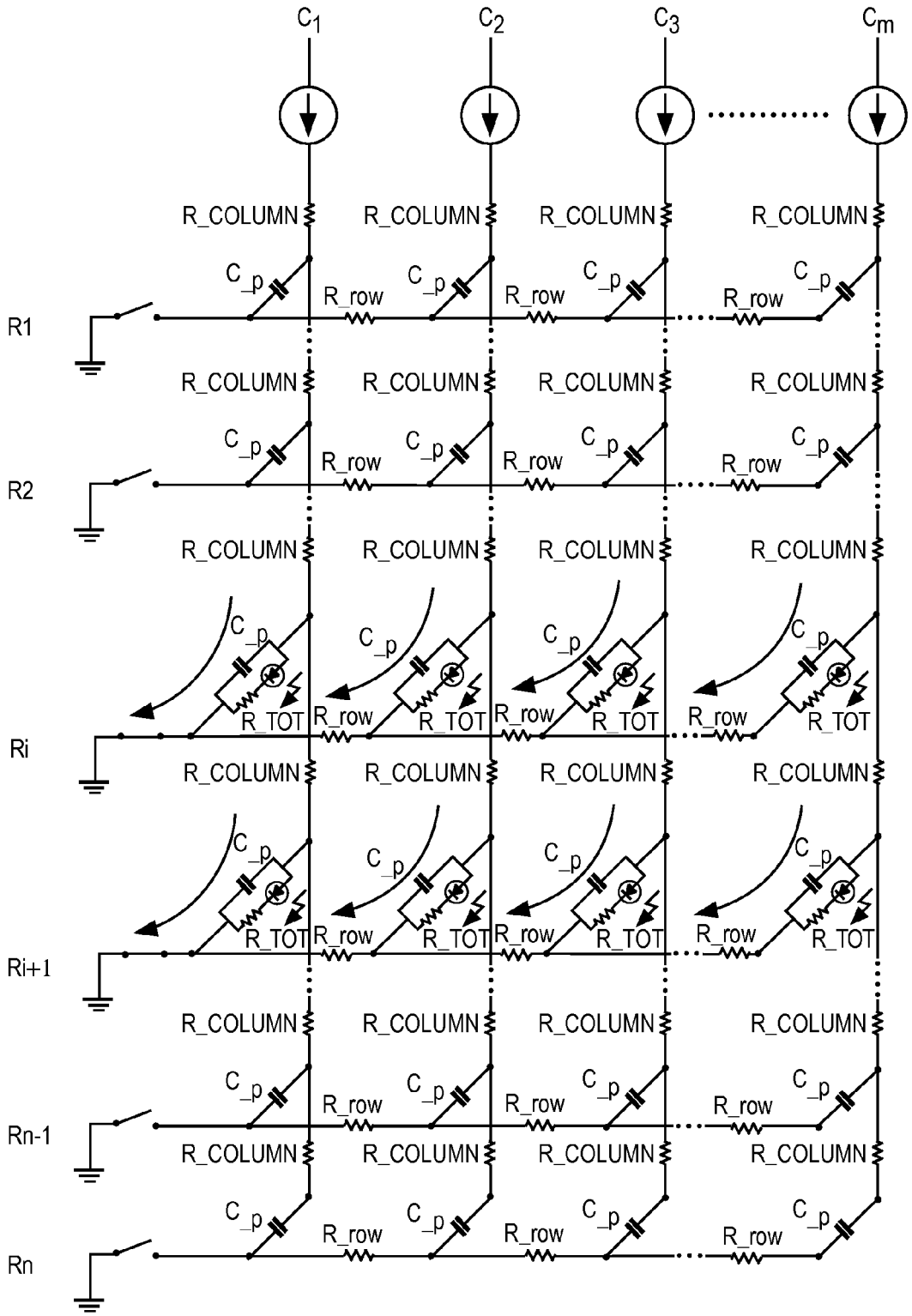
FIG. 4 shows the equivalent circuit of a matrix display with m columns ($C_m$) and n rows ($R_n$)

FIG. 1 schematically shows a matrix display D which is made up of four rows i and four columns j. The matrix display D correspondingly has a total of sixteen pixels ij which are to have the brightness $D_{ij}$. Each pixel ij is represented by a square in which the digital brightness value $D_{ij}$ is entered as a number. The brightness value "0" stands for a dark pixel ij, the brightness value "1" stands for a dimly luminous pixel ij and the brightness value "2" stands for a brightly luminous pixel.

FIG. 1*a* therefore shows a matrix display D on which a cross can be seen, with a dim centre in the pixel ij=23 and four bright pixels at its arcs. In conventional single-line addressing (SLA) the matrix display D is driven in such a manner that the rows one to four are activated consecutively in each case for a constant row addressing time $t_L$ which is given by the value "1" in arbitrary units. While the first row is being activated, an operating current I is applied to the third column, which current deposits a charge corresponding to the desired brightness "2" in the pixel ij=13. After a row addressing time of $t_L$=1 the process switches to the second row. In this second row, the columns two and four are supplied with an operating current I corresponding to the brightness "2" and the column three is supplied with an operating current I corresponding to the brightness "1" simultaneously. An analogous behaviour is produced in the case of a non-self-emitting display for the voltage applied for driving at the individual columns. A typical application is LCDs (Liquid Crystal Display).

After a further row addressing time $t_L$=1, the third row is driven analogously to the first row. Finally, the fourth row is activated for a further row addressing time $t_L$=1, which row is however completely dark, that is, during the selected phase of the fourth row (row addressing time for the fourth row), an operating current is applied to a pixel ij in none of the columns one to four.

After a total time $T_{Frame}=4*t_L$, all the pixels ij of the image matrix D have been driven once. The human eye integrates the consecutively illuminated pixels ij into a whole image.

This conventional method for driving a matrix display D by means of single-line addressing is modified according to the present technology as shown in FIG. 1*b*, in such a manner that the row addressing time $t_i$ for each row i is defined as a function of the maximum brightness $D^i_{max}$ of all the pixels at the intersection points of all the columns j and the row i. This method is also referred to below as "improved single-line addressing" (ISLA). The row addressing time $t_i$ is in this case dimensioned in such a manner that the sum $T_{Sum}$ of the row addressing times $t_i$ over all four rows corresponds to the total time $T_{Frame}=4*t_L$.

When dimensioning the row addressing times $t_i$, the procedure can be as follows. The maximum brightness $D^i_{max}$ of all the columns is for the first three rows in each case "2", so that the row addressing time $t_i$ for these first three rows must in each case be equal. In the fourth row the maximum brightness is "0", so that this row does not have to be driven at all and $t_i$=0 can be selected. The total time $T_{Frame}=4*t_L$ can therefore be divided into three row addressing times $t_i$ so that $t_i$ for the rows one to three can be selected to be a third longer than the constant row addressing time $t_L$, that is $$t_i = \frac{4}{3} \cdot t_L.$$

The first three rows can therefore in each case be activated a third longer than in the driving according to FIG. 1*a*. Since the light intensity in an OLED display depends on the charge which is impressed in the OLEDs and is given by the product of the applied operating current and the row addressing time, the operating current can be reduced accordingly by a quarter in order to reach the same integrated brightness value $D_{ij}$, that is $$I_1 = \frac{3}{4} \cdot I_o$$

The product of $t_L$ and $I_0$ is equal to the product of $t_i$ and $I_1$. This can also be seen by comparing FIGS. 2*a* and 2*b*. The illustrations in FIG. 2 show the operating current applied to the third column from FIG. 1 over all the rows one to four and the operating voltage proportional to it. The applied current (or the correspondingly applied voltage) is plotted during the row addressing time. As can be seen in FIG. 2*a*, the width of a box shown corresponds directly to the constant row addressing time $t_L$ which has been used in the above-described example as the standardising variable. One box corresponds to the activation time of a row. The total width consisting of four boxes corresponds to the total time $T_{Frame}$, within which an image of the matrix display can be completely built.

In FIG. 2*a*, the current waveform for known single-line addressing is described. In the first line, the current is maximal in correspondence with the desired brightness "2". For reasons of clarity, the associated driving pulse (current×time) for the pixel at the intersection point of the third column and the first line is shaded. This applies in each case also for the further illustrations of FIGS. 2*b* and 2*c*. In the second row with the brightness value "1", the current is halved. In the third row, the current is maximal again in order to achieve the brightness value "2". For the last row with the pixel switched off, the current is switched off. This type of driving corresponds to amplitude modulation.

FIG. 2*b* shows the current waveform for improved single-line addressing according to the present technology. As described, the row addressing times $t_i$ have been extended by a third. This is represented by the dashed lines. The fourth row is not activated at all. The brightness of a pixel ij is proportional to the impressed charge quantity which is determined by the current (operating current) integrated over time. As can be seen in FIG. 2*b*, the area below the current curve in FIG. 2*b* is equal to the area below the current curve in FIG. 2*a*, although the current (and respectively the applied voltage) could be reduced in each case by a quarter. This is advantageous for the lifetime of OLEDs.

A further embodiment of the present technology is described with reference to FIG. 1*c*. In this driving method, a plurality of rows are driven simultaneously (multi-line addressing). In the present example, these are the rows one and three, in which a pixel with the brightness "2" must be generated in each case in the third column (cf. FIG. 1*a*). Since two rows have been combined, the row addressing time can be doubled. The operating current (and respectively the corresponding voltage) is correspondingly halved per pixel (cf. FIG. 2*c* for one pixel).

As shown in FIG. 1*d*, it is particularly advantageous to combine the multi-line addressing method described with reference to FIG. 1*c* with improved single-line addressing corresponding to FIG. 1*b*. It is thereby possible to generate any images in multi-line addressing, since all the activated rows are driven identically in multi-line addressing. Remaining differences and/or residual rows can then be equalised by improved single-line addressing (MISLA).

In FIG. 1*d*, the second row according to FIG. 1*a* is then generated by a separate driving of a second matrix. This corresponds to a decomposition of the matrix display D into a plurality of matrices which are driven separately and together generate the desired image of the matrix display D. The driving takes place in such a rapid time cycle that the human eye cannot separate the sequential instances of the respective rows and/or matrices being driven and assembles them to form a whole image. The total time $T_{Frame}$, which is necessary for completely building an image, should therefore not be extended either when a plurality of matrices are used for driving. It is an advantageous procedure to keep the total time $T_{Frame}$ for activating all the rows to be driven in all the matrices constant and to adapt the respective row addressing times t correspondingly. The row addressing time $t_i$ for one row can in this case be quite different from that for another row, depending on the maximum brightness of the columns in the respective row. This case does not occur however in the currently described example.

The following method is produced for the combination of the matrices according to FIG. 1*c* and FIG. 1*d*. In each case exactly one row addressing time is needed per matrix for the driving. The maximum brightnesses $D_{ij}$ to be achieved are in each case equal. This means that two equal row addressing times $t_i=2*t_L$ are needed in order to reach a total time $T_{Frame}=4*t_L$. In correspondence with the doubling of the row addressing time with respect to the single-line addressing according to FIG. 1*c*, the operating current or the voltage for each individual pixel ij can be halved, wherein in the case of two-line addressing it must be taken into account that the circuit design of the column-by-column driving of a plurality of rows corresponds to a parallel circuit and the applied operating current is therefore distributed equally to the pixels of all the activated rows. In the case of two-line addressing in a matrix, the applied operating current is therefore to be doubled so that the same operating current is available at each pixel.

The current distribution for combined driving according to FIGS. 1*c* and 1*d* can be seen in FIG. 2*c* and shows a further reduction in the maximum operating current without losses in brightness in the matrix display D.

The driving method described using FIGS. 1 and 2 represents a highly simplified configuration with respect to the practical application and serves to explain the underlying idea. According to the present technology, this method can advantageously also be combined with elements of conventional or known methods, for example in connection with precharge and discharge technologies or the like.

A more complex example of driving matrix displays is described below in which all of the described features form the subject matter and are part of the present technology.

The starting point of the description is formed by the properties of a matrix display D which is shown in FIG. 3. The brightness $D_{ij}$ of a matrix display can be given in digital values, with the value "0" describing a switched off pixel. The maximum brightness in the matrix is $D_{max}$ (e.g. value "255" with 8-bit). The corresponding operating current is 1*o*. The level of $I_0$ is predefined or adjusted by the application. It represents the desired brightness of the display.

According to the previous SLA (single-line addressing) method which corresponds to the prior art, each row within a frame period (total time $T_{Frame}$) is assigned an equal, fixed or constant row addressing time $t_L$, in which the maximum brightness $D_{max}$ can be generated. For precisely one bit of brightness there is a corresponding time cycle $t_0$.

$$t_0 = \frac{t_L}{D_{max}} = \frac{T_{Frame}}{n \cdot D_{max}}$$

A specific brightness is converted into a number of time cycles $t_0$ by means of pulse width modulation (PWM) during brightness control. For the maximum brightness, the operating current $I_0$ flows for the row addressing time of $t_i=D_{max}*t_0$.

In the present technology, the necessary selection duration of a row, that is, the row addressing time $t_i$ selected for this row, is determined by the maximum brightness $D_{ij}$ of all the pixels ij in the selected row i. If the maximum brightness in this row is less than $D_{max}$, the next row can be activated earlier, that is the selected row addressing time $t_i$ can be shorter than $t_L$. The required total time for building an image is therefore:

$$T_{Sum}=D_{Sum}\cdot t_0 \leq T_{Frame}, \text{ where}$$

$$D_{Sum}=\sum_{i=1}^{n}\max(D_{i1}, D_{i2}, \ldots D_{im}) \leq n\cdot D_{max}$$

is the sum of the maximum brightnesses $D^i_{max}$ of a row over all the rows. $D^i_{max}$ is therefore the greatest brightness of all the columns in the row i.

This time $T_{Sum}$ is less than or equal to the total time $T_{Frame}$ and can be extended to $T_{Frame}$ by the operating current $I_0$ being reduced to the operating current $I_1$. The operating current $I_1$ which is adapted to the desired brightness is given by:

$$I_1=\frac{T_{Sum}}{T_{Frame}}\cdot I_0 = \frac{D_{Sum}}{n\cdot D_{max}}\cdot I_0.$$

The reduced operating current $I_1$ is therefore achieved in that the active or selected phase of a row (row addressing time $t_i$) is not tied to $t_L$. Instead, each row i only remains active for as long as the brightest pixel ij with the brightness $D^i_{max}$ on this row requires it. When the required time for the brightest pixel is reached, the process switches immediately to the next row.

With this time-optimised control method, the operating current $I_1$ and the time cycle for the row addressing $t_i$ are variable according to the present technology. The operating current is reduced to $I_1$ and the time cycle for exactly one bit of brightness (LSB, least significant bit) is increased from $t_0$ to $t_1$:

$$t_1=\frac{T_{Frame}}{D_{Sum}}$$

A simple example of this is illustrated in FIG. 3. The image of the matrix display in FIG. 3*a* is described in correspondence with FIG. 1 with the matrix D, which contains the brightness values $D_{ij}$ at the individual pixel positions ij.

The matrix D represents three bright stripes with in each case an intermediate dark stripe, wherein for the sake of simplicity grey scales up to 3 bits, that is a maximum brightness of $D_{max}=7$, are assumed. The matrix display D therefore contains a total of five rows and three columns.

In FIGS. 3*b* and 3*c*, the transient waveform of the (operating) current impressed in the second column is shown. FIG. 3*b* shows the current waveform in conventional single-line addressing (SLA), to which the transient waveform of the improved single-line addressing according to the present technology is compared in FIG. 3*c*.

Whereas in the case of single-line addressing (FIG. 3*b*) the current amplitude is for example constant at 70 μA and each row is activated for a constant row addressing time $t_L$ of 2.8 msec, the current amplitude in the case of improved single-line addressing (FIG. 3*c*) is 40 μA. The first, third and fifth rows are in each case active for a time (row addressing time $t_i$) of 4.2 msec and the second and fourth rows are active for a time (row addressing time $t_i$) of 0.7 msec.

The operating current $I_1$ used in the same manner for the driving of the whole matrix D and the time cycle $t_1$ for exactly one bit of brightness are now dependent on the image to be displayed in each case. Since in the case of passive matrix OLEDs the diode current is quite high on account of the multiplex mode, the quantum efficiency or the light intensity per current unit is relatively low. The quantum efficiency increases with reduced operating current, which can lead to a further reduced operating current:

$$I_1=\frac{D_{Sum}}{n\cdot D_{max}}\cdot I_0\cdot\frac{\eta(I_0)}{\eta(I_1)}$$

η(I) is the quantum efficiency with the current I in the unit Cd/A. The profile of the quantum efficiency is stored in a gamma table and can be used for the above calculation by means of driving electronics according to the present technology, which implement the described method.

Since the operating current $I_1$ is reduced compared to known driving, the flow voltage of the OLED diodes also falls. The efficiency with the unit Lm/W also increases thereby, since the consumed energy is equal to the integration of the product of current and voltage over the frame period. The higher efficiency achieved also means a lower self-heating of the display, which leads to an increase in the lifetime of the display.

The implementation outlay is low for this because the operating current $I_1$ for the display must only be set once and a time cycle $t_1$ is easy to implement.

In the driving variant described above, the sum $D_{Sum}$ of the maximum brightnesses $D^i_{max}$ of a row is a predefined, invariable amount. If a plurality of rows are combined and driven simultaneously in a matrix, the possibility exists of minimising or further reducing $D_{Sum}$. During a row addressing time $t_i$, a plurality of rows are then selected simultaneously, so that the required time for driving the whole image matrix can be reduced as a whole. The operating current can also be further reduced thereby.

FIG. 4 shows a circuit diagram of how two rows Ri and Ri+1 are addressed simultaneously. The impressed column current is now $2*I_1$ and is distributed equally to the two diodes of the individual rows Ri and Ri+1. The diodes on the remaining rows are passive and are shown only with the parasitic capacitance $C_p$. The light intensities are equal in the respective diodes of a column in the simultaneously addressed rows because the same current is applied to each of them. In comparison to single-line addressing, only one row addressing time $t_i$ is therefore needed for the two rows in order to generate the same brightness in the driven pixels.

This approach also applies when more than two rows are addressed simultaneously. The more rows are combined, the greater the time saving. This is then multi-line addressing.

The combination of a plurality of rows is not however easily possible, since now a plurality of pixels of a column in a plurality of rows are driven equally. There is therefore no longer any difference between these pixels in terms of their brightness, so that differential information is lost or the resolution is reduced.

This problem is solved in that multi-line addressing (MLA) is combined with the above-described optimised improved single-line addressing (ISLA) by decomposing the desired matrix display D into a plurality of matrices. That is, a row in different matrices S, M is addressed both alone and together with other rows. The difference in light intensity between the pixels in the different rows of the respective column, which are however driven together in multi-line addressing, is realised with the matrix S by means of improved single-line addressing. Multi-line addressing should minimise the required total time $T_{Sum}$. The conversion of a matrix display D into a single-line matrix S and a multi-line matrix M is represented mathematically as follows.

$$D=S+M2,$$

where M2 is the matrix for two-line addressing. The matrix S is also referred to as a residual single-line-matrix. The fundamental structure of the matrices can be seen in FIG. 5.

The source data for the individual pixel brightnesses $D_{ij}$ of the matrix display D, which data is assembled to form the desired image, is decomposed into two matrices S and M2. S is the single-line matrix which is driven by means of improved single-line addressing. M2 is the multi-line matrix, for whose driving in each case two rows are combined and addressed or activated together. The representation of M2 in n−1 matrices, where n is the number of rows of the matrix display D, shows that two rows are combined for each of these matrices M, since the entries in the two rows are identical. The combination of two rows is preferably carried out for two consecutive rows because it is assumed that consecutive rows of an image have the greatest similarities and the distribution of the two operating currents in two pixels in consecutive rows of a real display is the most homogenous. In addition, the mathematical decomposition for this restriction is simpler than if two arbitrary rows are combined. The implementation of the algorithms then has a low outlay and is described in more detail below in a realisation according to the present technology.

Non-adjacent rows can of course also be combined, depending on the application. For example, chessboard patterns can be produced very well with multi-line addressing by means of the combination of two rows which are separated from one another by an intermediate row.

The row addressing time $t_i$ which each pair of rows receives for the activation depends analogously to the above-described realisation on the maximum brightness Mij of a pixel in this pair of rows. The time-optimised driving method which has already been described for single-line addressing is also used here. The sum of the row addressing times is therefore produced as follows:

$$T_{Sum}\square\sum_{i=1}^{n}\max(S_{i1}, S_{i2}, \ldots S_{im})+\sum_{i=1}^{n-1}\max(M2_{i1}, M2_{i2}, \ldots M2_{im})=D_{Sum},$$

where $\max(S_{i1}, \ldots S_{im})$ and $\max(M2_{i1}, \ldots, M2_{im})$ give in each case the maximum brightness of a row, which is proportional to the respective row addressing time $t_i$.

The aim of decomposition into a plurality of matrices is a further reduction of the operating current $I_1$, that is, a minimisation of $D_{Sum}$. This is achieved by each brightness $M2_{ij}$ of the multi-line matrix M2 reducing two elements in the single-line matrix, namely $S_{ij}$ and $S_{i+1,j}$ by the amount $M2_{ij}$ from the original data $D_{ij}$ und $D_{i+1,j}$. Only one row addressing time $t_i$, namely the time for addressing $M2_{ij}$, is however required for this. The effect is correspondingly greater for a plurality of rows.

The transformation of the source data (matrix display D) in a plurality of multi-line matrices is defined analogously by $$D=S+M2+M3+\ldots$$

where M3 describes a simultaneous driving of three rows (cf. FIG. 5). A simultaneous addressing of even more rows takes place correspondingly.

It is also possible to omit some multi-line matrices, for example according to the definition $$D=S+M2+M4,$$

in which the matrix M3 is set to zero. Single-line addressing can also be interpreted in such a manner that all the elements of the multi-line matrices Mx are set to zero.

The idea of dividing an image or an image matrix D into a plurality of images or image matrices S, M which are easier to drive can be used for all matrix display types including LCD and plasma displays. The multi-line matrix is a good example of simple and efficient driving.

Complete multi-line addressing including single-line addressing is described using a concrete example below. The aim of the transformations carried out is the minimisation of $D_{Sum}$. The result is that the operating current is no longer $I_0$ but can be much less (depending on the image):

$$I_1=\frac{D_{Sum}}{n\cdot D_{max}}\cdot I_0$$

In the example shown in FIG. 6, a 4×9 matrix D is decomposed into two matrices M2 and S. The number of rows in this matrix D is n=9. $D_{max}$ has the brightness value "15" (4 bits).

The first matrix in FIG. 6 gives the desired brightnesses $D_{ij}$ of the matrix display D. The second matrix is two-line matrix M2 and the third is the residual single-line matrix S. M2 is again shown separately, wherein it can be seen in the illustration of the sums how in simultaneous addressing the brightnesses are distributed in each case to two adjacent rows. $D_{Sum}$, that is, the sum of the maximum brightnesses of simultaneously activated rows, is $D_{Sum}$=72 when using the two-line matrix. If only improved single-line addressing is used, $D_{Sum}$=107. Compared to $n*D_{max}=9*15=135$, the required operating current is therefore reduced to 53% of the conventional driving method by using the two-line matrix.

If three-line matrix addressing M3 in accordance with FIG. 7 is used, $D_{Sum}$ can be further reduced. The first matrix according to FIG. 7 is the same as the source matrix in FIG. 6 and reproduces the desired brightnesses $D_{ij}$ of the matrix display D. The second matrix is the three-line matrix M3, the third matrix is the two-line matrix M2 and the fourth is the residual single-line matrix S. $D_{Sum}$ is in this case reduced further to 58. Compared to $n*D_{max}$=135, a reduction of the operating current amplitude by 57% is therefore achieved.

FIG. 8 shows the voltage waveform of the eighth row, the current and voltage waveform of the second column and the voltage at a diode ($D_{82}$) for the two-line addressing according to FIG. 6.

In the example shown, the operating current $I_0$ for the conventional single-line addressing is 100 μA. Corresponding to the reduction to 53%, the operating current during driving of one row is therefore $I_1$=53 μA. The flow voltage of the OLED at 53 μA is 6 V. The threshold voltage of the OLED is 3 V. A frame period, that is the total time $T_{Frame}$, is 13.5 msec. In conventional single-line addressing, the constant row addressing time is $t_0$=0.1 msec. In multi-line addressing according to FIG. 6, $t_1$=0.1875 msec. A frame now consists of 72 ($D_{Sum}$) $t_1$-cycles.

The S matrix and M2 matrix are activated alternately. First the first row of the S matrix is addressed, then the first pair of rows of the M2 matrix (that is, its rows 1 and 2), then the second row of the S matrix, then the second pair of rows of the M2 matrix (that is, its rows 2 and 3), etc.

Figure 8A:
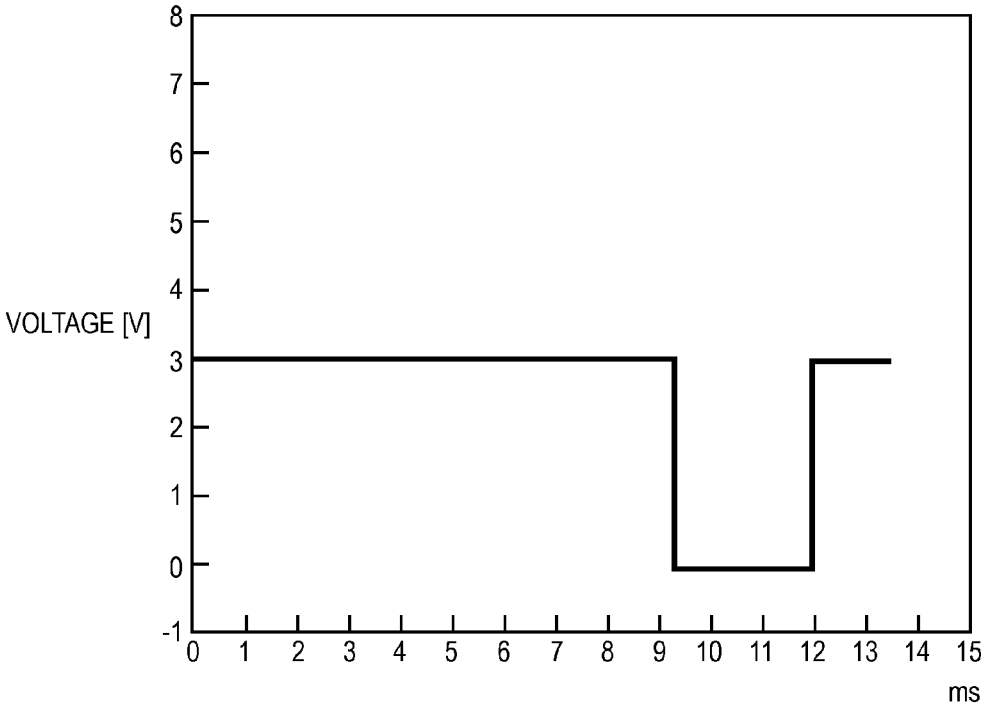
FIG. 8 shows voltage and current waveforms for selected lines of matrices according to FIG. 6.

FIG. 8*a* shows the voltage waveform of the eighth row. A corresponding row switch (cf. accordingly FIG. 4) is then closed when this row is addressed so that a current can flow. The voltage is then zero. Otherwise the row switch is open. Since a column voltage is always flowing, a column voltage of at least 6 V prevails. The row voltage of 3 V is given by the 6 V column voltage minus a threshold voltage of e.g. 3 V in the case of an OLED. The eighth row is addressed for 2.625 msec (from 9.375 msec to 12 msec).

Figure 8B:
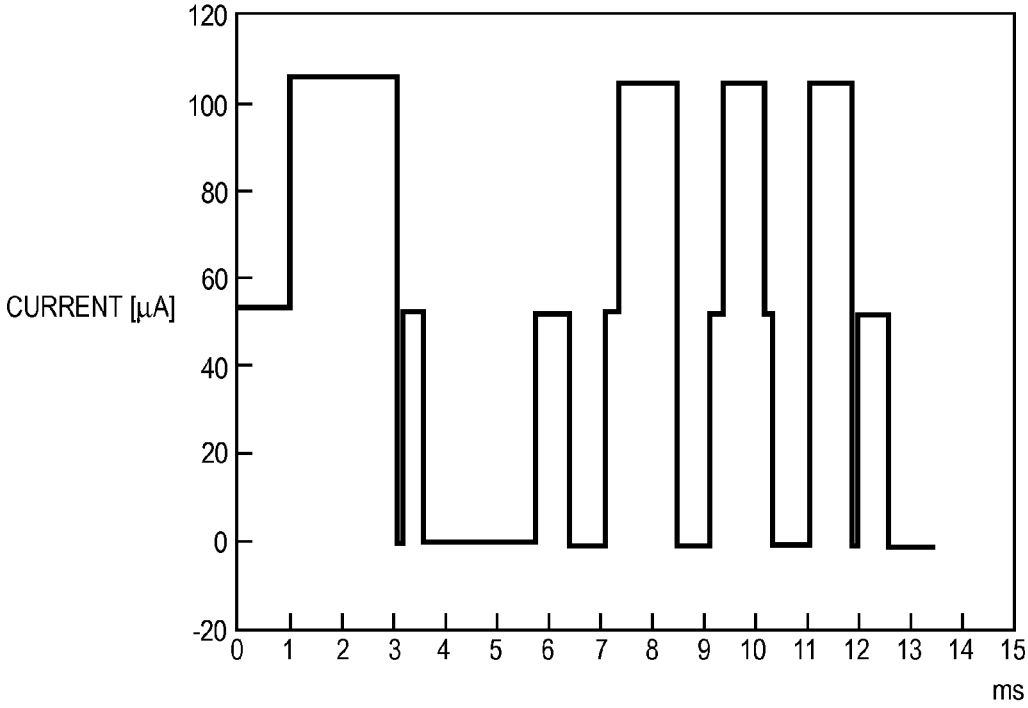

FIG. 8*b* shows the operating current in the second column. Three levels can be seen in the current waveform, namely zero, when none of the pixel diodes are active, 53 μA, when only one pixel diode is active and 106 μA, when two pixel diodes (in the context of two-line addressing) are active. In the case of two-line addressing, the current amplitude at each diode is also 53 μA, because the total current is distributed equally to both of the simultaneously driven pixel diodes.

The time span (row addressing time $t_i$), during which the eighth row is activated, consists of three phases. During the first four cycles (from 9.375 msec to 10.125 msec), row 7 and row 8 are addressed together. The current is therefore also 2*53 μA. This corresponds to the row addressing of $M2_{72}$.

In the next five cycles, row 8 of $S_{82}$ is addressed. The total of five cycles of the row addressing time $t_i$ comes from the maximum of the brightness Sij of the eighth row of the matrix S having the value 5 (see 1st column, 8th row). A current of 53 μA flows for a time of 0.1875 msec (one cycle). The current is then zero for four further cycles, since the maximum of the eighth row of the S matrix ($S_{81}$) is 5 and the brightness control is made by means of pulse width modulation.

The last phase lasts for 5 cycles, during which the eighth and ninth row of the matrix M2 are addressed. The current is again 106 μA. The current only flows for 4 cycles however, since $M2_{82}$ is 4. The current falls back to zero for one cycle. Current still flows in the third column in this last cycle also (not shown), because the maximum brightness in the third column is $M2_{83}$=5. The total duration during which operating current is applied to the pixel ij=82 (active time) is 9 cycles, which corresponds to $D_{82}$.

Figure 8C:
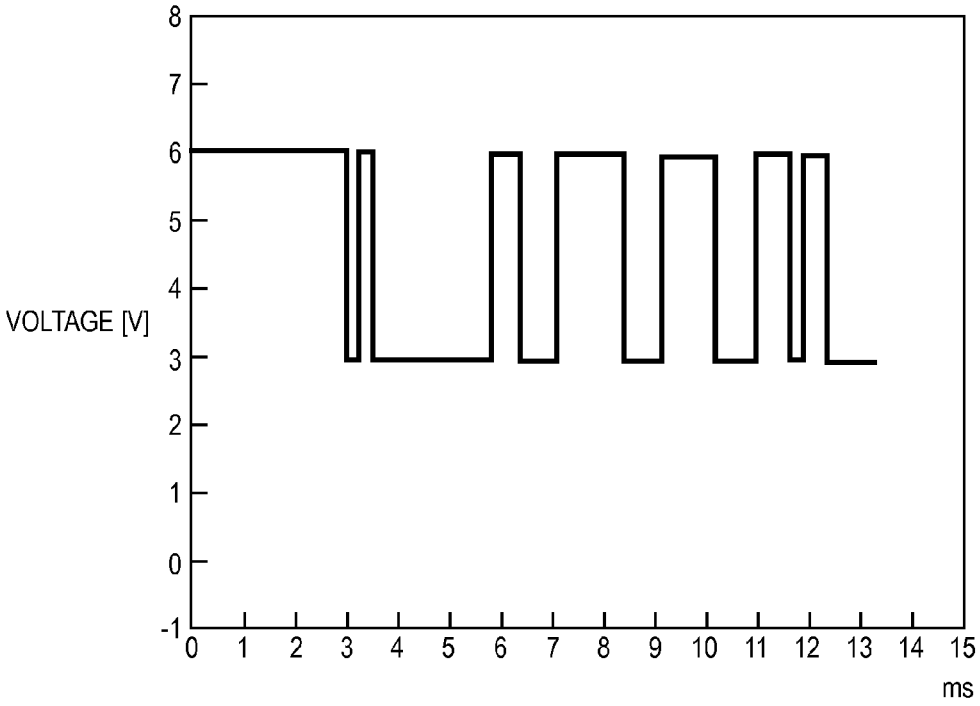

The transient waveform of the voltage in the second column is shown in FIG. 8*c*. It is 6 V when an operating current is flowing and is independent of whether the operating current is 53 μA or 106 μA, since at 106 μA the operating current is divided by two diodes. If there is no current flowing, the voltage falls to 3V. This corresponds to the threshold voltage below which no diode current can flow.

Figure 8D:
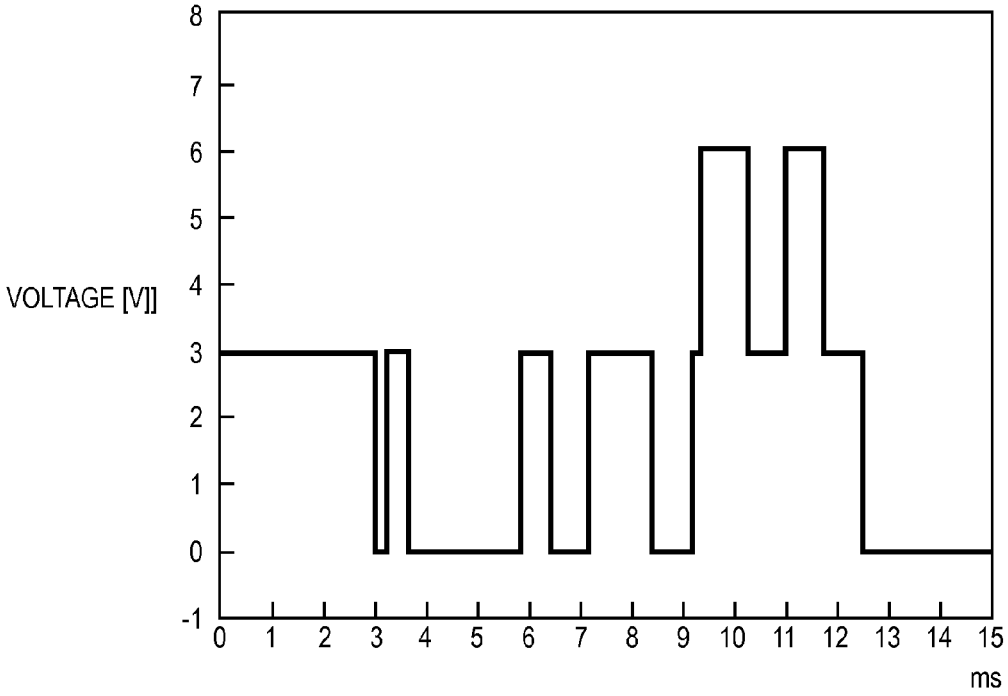

FIG. 8*d* shows the transient waveform of the voltage at the diode in the pixel ij=82. The voltage is 6 V when an operating current of 53 μA is flowing through this diode. During the addressed time of the eighth row, no current flows for 4 cycles. During this time the voltage at the pixel is 3 V (threshold voltage). When there is no current flowing in the second column, the voltage at the row switch and at the column switch is 3 V, therefore the voltage at this pixel is then zero. When a current is flowing through the second column, the column voltage is 6 V and draws the potential of this unaddressed row 8 to 3 V (6 V minus threshold voltage).

The technical implementation of the method according to the present technology for driving matrix displays is as simple as conventional single-line addressing methods. There is a switch on each row and each column is provided with a current source which in the case of two-line addressing has three current levels (such as 0, 1 und 2), whereas in the case of a conventional single-line addressing method there are only two levels (such as 0 and 1). This is because the correspondingly increased current must be available when a plurality of rows are addressed simultaneously. It is generally the case that a graduation with n+1 levels is required when n rows are addressed simultaneously. This is to be implemented however with a low outlay. A concrete circuit for a mixed amplitude and pulse width modulation for controlling brightness is described in more detail below.

In the above-described example, pulse width modulation of the operating current was used. The S and the M2 matrices can of course also be produced by means of amplitude modulation of the operating current. In amplitude modulation, each row or each plurality of rows is addressed until it corresponds to the maximum on this row or plurality of rows. This is the same in pulse width modulation. The only difference is that the operating current flows constantly during the row addressing time $t_i$ and the level of its amplitude is adapted.

The optimised and efficient conversion of the source matrix (matrix display D) into multi-line matrices M and a single-line matrix S is decisive for minimising the operating current. Optimised means a minimisation of the sum of the maximum brightnesses $D_{Sum}$ and efficient means a conversion which can be carried out rapidly and with a low outlay on hardware.

The matrices M and S can be obtained or determined in principle with known methods such as linear programming and with standard software. However, complex arithmetic operations such as multiplication and division must then be used, with the result that this method is very slow and calculation-intensive. In addition, the complexity increases more than quadratically with the size of the image matrix.

A combinatorial method is therefore proposed according to the present technology, which is based on what is known as the "MaxFlow/MinCut" principle. Since the quality of the optimum depends essentially on how two successive rows differ, the side condition D=S+M2+M3+ . . . is rearranged by forming the difference between two successive equations without changing the solution space. The matrices d', S' and M2', M3' are produced as shown in FIG. 9. The matrix S' is formed analogously to the matrix d'. The sum of each column of the matrices is zero.

Figures 10, 11:
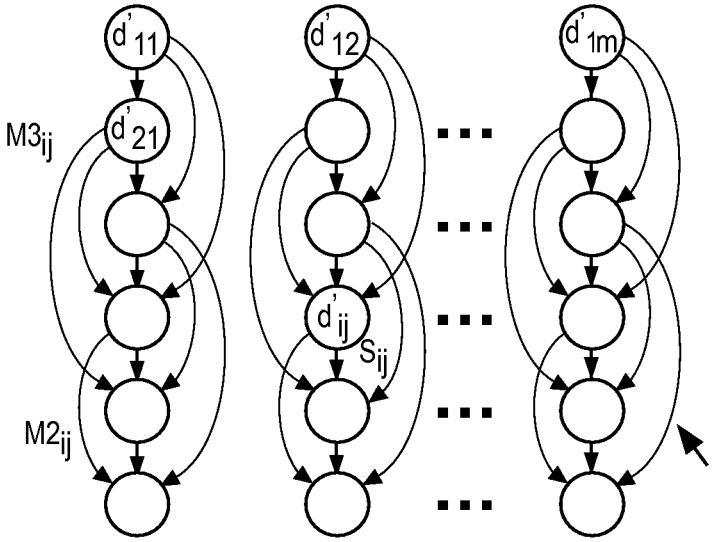
FIG. 10 shows a flow diagram of the flow matrix d' according to FIG. 9.
FIG. 11 shows a concrete example of the matrix D according to FIG. 6 converted into the flow matrix d'.

The rearranged side conditions can be visualised by means of the graph shown in FIG. 10.

Here, each vertex (from a vertex set V), which is shown as a circle, represents an entry in the rearranged matrix d'. $d'_{ij}$ in the circle represents the corresponding element of the matrix d' which is shown in FIG. 9. The value of this vertex is therefore equal to the value of the matrix element $d'_{ij}$. The arcs between the matrix elements $d'_{ij}$ are the arrows which lead from one vertex or circle to another vertex or circle. Each of these arcs has a direction which is represented by the arrow and allocated a number. This allocation (number) of the arcs (from the arc set A) reflects the value which the corresponding variable has in the decomposition of the source data matrix display. Arcs which extend from one row to the next belong to the matrix S. Arcs which skip a row, that is have the length "2", are assigned to the matrix M2. Arcs with length three are correspondingly assigned to the matrix M3 and an analogous assignment takes place for the matrices M4, M5 etc. The indices of the arcs are designated ij, where "i" is the row number for the start vertex (circle) and "j" is the number for the column.

Figure 12:
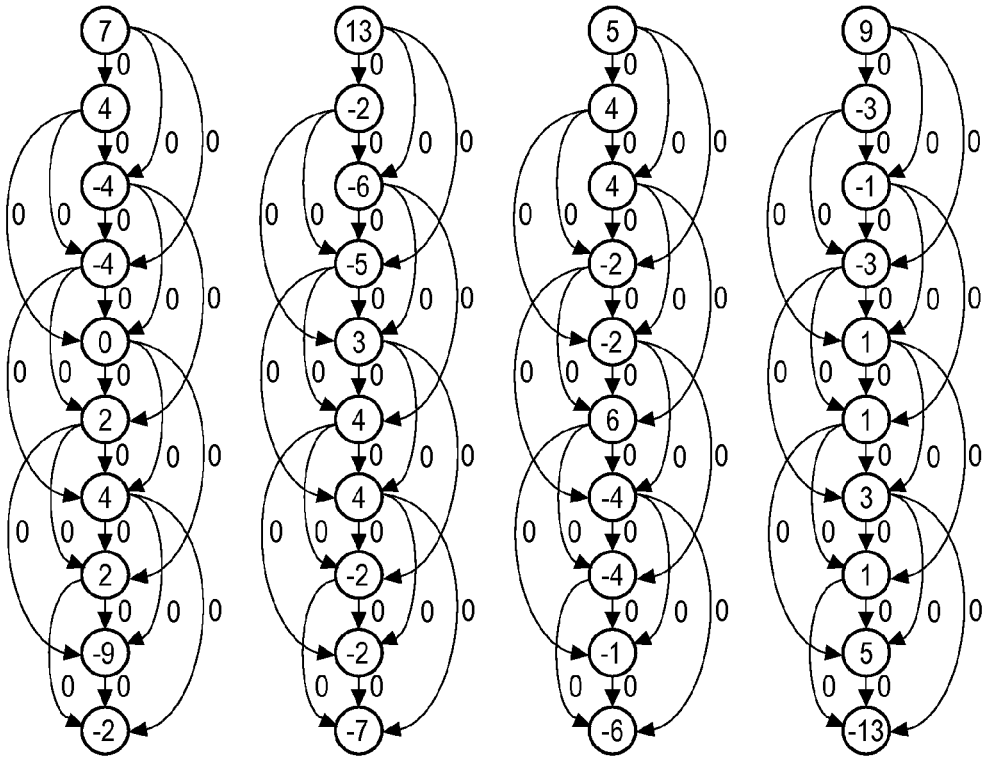
FIG. 12 shows a flow diagram of the flow matrix d' according to FIG. 11 in a first optimisation step.

This is explained below using the example already dealt with in FIGS. 6 and 7. The 4×9 matrix D from FIG. 6 is transformed into a 4×10 flow matrix d' which is given in FIG. 11. This matrix d' is shown in FIG. 12 as a flow to be balanced.

Each element of the d' matrix corresponds to a vertex in the corresponding position. The arcs are all still allocated zero, since this is the start of the matrix decomposition. A valid decomposition is achieved exactly when the sum of the allocations (numbers) of the outgoing arcs (arrows going out from the circle) minus the sum of the allocations (numbers) of the incoming arcs (arrows arriving at the circle) of each vertex (circle) is equal to the respective value (demand) of the vertex. All the arc allocations are not negative.

Figure 13:
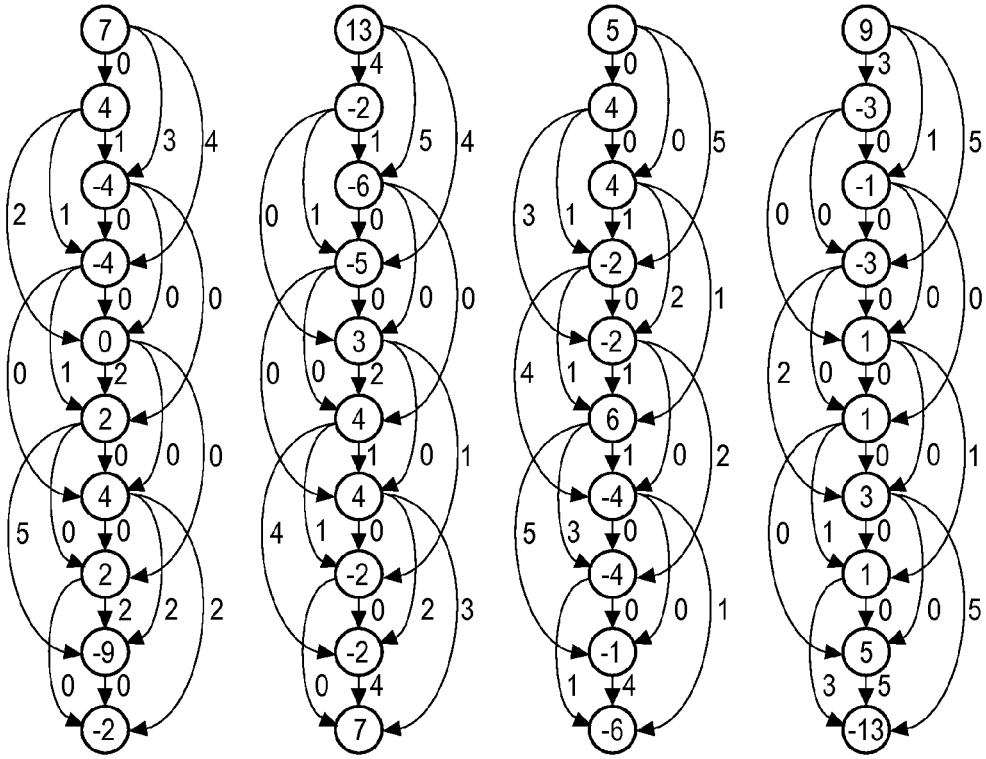
FIG. 13 shows a flow diagram of the flow matrix d' according to FIG. 11 after the optimisation step.

FIG. 13 shows the result of the balanced flow. All elements of the matrices M3, M2 and S are obtained from the allocations of the arcs.

The mathematical method with which the balanced flow shown in FIG. 13 is created is described in more detail below.

Two arcs (arrows) in FIG. 13 should be the same type if start and end vertexes of both arcs are in each case in the same row. The aim is to find a valid allocation of the arcs so that the sum of the maximum arcs of an arc type is minimised. This can be described mathematically as follows. A directed graph G=(V, A) is given wherein the arc set A according to type is partitioned into $A=A_1\dot{\cup}A_2\dot{\cup}\ldots\dot{\cup}A_p$. p is the number of rows of the multi-line matrices M and the residual single-line matrix S. Furthermore, there is a function $b:V\rightarrow Z$, which assigns each vertex with its demand. Z is a whole number (integer). A function $f:A\rightarrow Z_{\geqq 0}$ (is sought, so that for each vertex $v\in V$ the equation $$\sum_{\substack{a\in A\\ v \text{ ist Starknote von } a}} f(a) - \sum_{\substack{a\in A\\ v \text{ ist Endknote von } a}} f(a) = b(v)$$

applies and $$D_{Sum} = \sum_{k=1}^{p} \max\{f(a) : a \in A_k\}$$

is minimal. The upper equation is also called "flow conservation" and corresponds to Kirchhoffs current law. b(v) is the demand of this vertex and can be considered as the current flow from ground into this vertex (where, in the event of negative demand, the current flows from the vertex to ground). $D_{Sum}$ is to be minimised.

The above-mentioned object is equivalent to the problem of assigning a non-negative number (what is known as a capacity) to each arc type $A_k$, k=1, . . . , p so that the sum of these capacities is minimal and a valid allocation of the arcs exists, which does not exceed the capacities.

The special feature of this new method is that the capacity is valid for all arcs of a defined length of a row. The flow to each of these arcs is less than or equal to this capacity. The capacities themselves are variable and represent in a certain manner the costs or outlay for the optimisation. The sum of all the capacities must be minimised. In contrast to a known MaxFlow/MinCut method in which the flow is maximised with given capacities, in this case the capacity is minimised with a given flow.

The capacities are a function $u:\{1, \ldots, p\}\rightarrow Z_{\geqq 0C}$, so that for all $k\in\{1, \ldots, p\}$ and $a\in A_k$ the following in equation applies: $f(a)\leqq u(k)$.

The above-described minimisation can in principle also be modelled and solved as a linear program, which is however very calculation-intensive, as already mentioned. As shown below, the above-described method according to the present technology can be implemented mathematically with only a low outlay, as follows.

To this end, the capacities are increased successively, that is step-by-step, from zero upwards until a valid decomposition is possible. This also ensures that the capacity is greater than or equal to zero. In each iteration the set of arcs is determined whose allocation is equal to the capacity and thus constitutes a bottleneck which prevents a valid solution. This arc set, also called minimum cut, separates the vertexes with a positive demand from those with a negative demand. The capacities of the arcs are then increased from the minimum cut. This however preferably only happens for the capacity which allows most of the arcs to leave the bottleneck. The allocations are now increased until either a valid solution has been found or a new bottleneck occurs, whereupon the described steps are repeated.

A mathematical formulation of the method sequence can be seen in FIG. 14. The program modules "MaxFlow" and "MinCut" are the standard methods known from the literature. The program module "Initialise" defines the start value for u, for example, u(k)=0 can apply for all $k\in E\{1, \ldots, p\}$. Lower bounds are however preferably used, which have been generated by pre-processing the data. The set H describes the history of the calculated MinCuts. The outgoing arcs of the current MinCut are referred to with $C\subset A$ and the outgoing arcs of the MinCut of the iteration i are referred to with $C_i\subset A$. The parameter □u determines the step size with which the individual capacities are increased. Preferably only a few capacities are increased per iteration (e.g. only for the k, for the $|A_k\cap C|$ or the weighted sum $$\sum_{C_i\in H} w_i \cdot |A_k \cap C_i|$$

is maximal, wherein earlier steps are weighted less. w describes the weighting of the history. The choice of the size of the step allows a compromise between the quality of the method (small □u, e.g. □u=1) and running time (greater □u) and can also be adapted dynamically.

The method of the present technology can of course also be used for a part region of an image matrix. In this manner an image can be divided into a plurality of segments and each optimised separately, which corresponds to a local optimisation.

A mixed global and local optimisation can likewise be carried out, by displacing a segment of a defined size row by row or by a plurality of rows. The submatrix is formed from a defined number of rows. It is first formed from the upper rows of the source matrix. With each optimisation, the matrix entries (S, M2, M3 etc.) are obtained for the top row or top few rows. The next submatrix is accordingly displaced downwards by one or a plurality of rows. The influence of the previously obtained multi-line matrix row on this new submatrix must be subtracted. Then one or a plurality of rows are obtained again from S, M2, M3 etc. The submatrix runs until the end of the source matrix and is then completely decomposed. In this way all entries of S, M2, M3 etc. are obtained.

The decomposition of a relatively small matrix requires little memory size and few iterations. With a global optimisation in which the matrix is generally large, the result of the matrix decomposition must be stored in a buffer memory such as an SRAM or the like. The information is not read row by row into the register for the output driver until directly before the activation. With segmented/local or mixed optimisation, the capacities can be obtained first by means of the submatrix decomposition and consequently also by means of their sums, $t_i$ und $I_1$ respectively. Thanks to the rapid decomposition, the row result is then successively calculated again and forwarded directly to the register for the output driver so that the large buffer memory can be omitted. The hardware outlay can be reduced by segmented/local or mixed optimisation, whereas the quality of the optimisation can be reduced somewhat in this case.

If the matrices M, S with the individual pixels ij of corresponding brightnesses are fixed, the diodes must be driven correspondingly. The individual row addressing times $t_i$ can vary from row to row and in each case follow the maximum brightness value of these rows. The brightness can be controlled by means of pulse width modulation or amplitude modulation of the current.

With pulse width modulation, only the pixels ij with the maximum brightness are switched on during the entire row addressing time, that is the operating current flows through them. The remaining pixels ij light up only temporarily, with the respective light-up time being correlated with the respective brightness value Sij, Mij.

Alternatively, amplitude modulation can also be used to control the brightness, so that all the pixels ij in the active phase, that is during the respective row addressing time $t_i$, are switched on 100% of the time and the operating current in pixels ij with lower brightness is reduced correspondingly. Amplitude modulation is however more difficult to implement with regard to hardware. This applies in particular in the case of high colour depth or a large number of greyscales, whereas pulse width modulation can be implemented comparatively simply and precisely without a high outlay being required for the hardware used.

It is particularly advantageous to combine pulse width modulation with amplitude modulation in order to reduce the operating current in pixels ij with lower brightness. This mixed or combined amplitude and pulse width modulation according to the present technology is explained below with reference to FIG. 15 to FIG. 18.

For the above-mentioned multi-line addressing according to the present technology, the operating current must be quantified, that is, divided into a plurality of different levels, in order to feed the currents for single, two and multi-line addressing into the columns and to adjust the level of the current accordingly. For example, for four simultaneously driven rows in multi-line addressing M4, four times the operating current ($4*I_1$) must also be impressed.

To this end, the current source can be implemented with three transistors, as shown in FIG. 15, consisting of two single-transistor cells and one two-transistor cell. These three transistors receive the same control voltage at the gate when an operating current $I=4*I_1$ is required for four rows. If an operating current of $I=3*I_1$ is needed, no control voltage is applied to one single-transistor cell, while a control voltage is applied at the respective gate for the two-transistor cell and the other single-transistor cell. For an operating current of $I=2*I_1$, either the two-transistor cell is active and the two single-transistor cells are passive, or vice versa. For an operating current $I=I_1$, only one single-transistor cell is active.

The quantified operating current can also be used to reduce once again the operating current given a matrix entry whose brightness value $M_{ij}$, S is not a maximum. The algorithm shown in FIG. 18 for the brightness values $M_{ij}$ can for example be used for this purpose. The result corresponds to combined pulse width and amplitude modulation for controlling brightness.

The result of this combined brightness control is shown in FIG. 17 in comparison to exclusive pulse width modulation for controlling brightness (FIG. 16). In a pure pulse width modulation, the current amplitude is for example a constant 100 μA. The pulse width of the first pulse is 6 of 10 units (6/10), wherein the active duration of this row is 10 units (row addressing time of 10 units). Since 6 units is greater than half of 10 units and less than ¾ of 10 units, the pulse width of the first pulse is extended to 4/3 of the original value with the mixed amplitude/pulse width modulation. At the same time, the amplitude is reduced to ¾ of the original amplitude (that is in the example 75 μA). This can also be seen in FIG. 17 in comparison with FIG. 16. The pulse width of the second pulse is doubled, while the amplitude is halved analogously thereto. The third and the fifth pulses cannot be extended, since their pulse widths are close to the active duration (row addressing time) of the respective row. The width of the fourth pulse can in contrast be quadrupled.

It can be seen clearly in FIG. 17 that the mean amplitude of the operating current is reduced in a mixed or combined amplitude and pulse width modulation for controlling brightness.

Of course, only parts of the above algorithms shown in FIG. 18 can be used. These algorithms also apply for the single-line matrix. In multi-line addressing with a different number of rows, the algorithms are formulated in a corresponding manner. The algorithms follow the quantification of the current source.

With the present method for driving matrix displays and a display control system set up for carrying out the above-described method, to which control system the present technology also relates, it is therefore possible to achieve optimised driving of matrix displays. This can be used for improving performance, for example an increased frame rate, and/or for reducing the operating current required for driving the individual pixels. Essential features are that the row addressing time for each row depends on the maximum brightness which a pixel in this row must achieve, and/or that the matrix display is decomposed into a plurality of separate matrices of which some represent multi-line driving.

The present technology also relates to a control system for carrying out the above-described method. To this end, the claimed method can be implemented in an application specific IC (ASIC), if for example the display controller and the display driver are integrated in one chip. $t_1$ and $I_1$ are generated in the driver. The matrix decomposition is realised with combinatorial logics which are simple and fast.

Since an image and consequently also the derived matrices are always data intensive, a memory is also required. This requirement can be reduced with a modern semiconductor process or as described above also with local or mixed optimisation. The present method can also of course be divided between a plurality of chips.

The invention claimed is:

1. A method for driving a matrix display or a part region of a matrix display comprising:

driving a plurality of lines with individual pixels, wherein the lines are configured as rows and columns, further wherein individual lines are driven selectively in such a way that rows are activated for a defined row addressing time and an operating current or a corresponding voltage applied to the columns in correlation with the activated row corresponding to the desired brightness in the pixels; and determining the row addressing time for each row variably as a function of the ratio of the maximum brightness of all the columns of each row to a maximum possible pixel brightness decomposing source data for the individual pixel brightnesses ($D_{ij}$) of the matrix display into a plurality of matrices for driving the display, wherein the superposition of all the matrices generates the image of the matrix display or the part region of the matrix display at the desired brightness of the respective pixels; and wherein the plurality of matrices includes one matrix for driving single lines of the display and one or a plurality of matrices for driving multiple lines of the display simultaneously.

2. The method of claim 1, wherein individual lines with individual pixels configured as adjacent rows are driven simultaneously.

3. The method of claim 1, wherein the source data for the individual pixel brightness ($D_{ij}$) of the matrix display is converted into a flow matrix which has as entries vertexes which correspond to the demand for brightness differences of individual pixels in the column.

4. The method of claim 3, wherein the flow matrix is produced from the difference between at least two matrices, wherein the first matrix consists of the matrix display and a row with zero entries attached to the end of the matrix display and the second matrix consists of the matrix display and a row with zero entries upstream of the matrix display.

5. The method of claim 3, wherein the vertexes are connected by arrows which are referred to as arcs, to which an allocation is assigned, and which preferably correspond in accordance with their length to the entries the plurality of separately driven matrices.

6. The method of claim 5, wherein each row of a matrix is assigned a capacity.

7. The method of claim 6, wherein the capacity value is variable and is increased until a valid assignment of the arcs is achieved.

8. The method of claim 7, wherein the step size with which the capacity value is increased is dynamically adapted.

9. The method of claim 6, wherein the capacities are increased, which are selected according to local criteria.

10. The method of claim 9, wherein a local criterion is a minimum cut.

11. The method of claim 10, wherein a local criterion is information about preceding minimum cuts.

12. The method of claim 9, wherein a local criterion is information about preceding minimum cuts.

13. The method of claim 3, wherein the source data for the individual pixel brightness (Dij) of the matrix display is decomposed into a plurality of submatrices and the submatrices are decomposed separately into flow submatrices.

14. The method of claim 13, wherein a mixed local and global optimization is carried out, wherein one or more rows of multi-line matrices or single-line matrices are obtained from a flow submatrix.

15. A self-emitting display made according to the driving method of claim 1.

16. A non-self-emitting display made according to the driving method of claim 1.

17. A display control system with a display controller and a display driver for driving a matrix display or a part region of a matrix display, wherein the matrix display on the part region of a matrix display comprises:

a plurality of lines with individual pixels, wherein the lines are configured as rows and columns, and further wherein individual lines can be driven selectively by rows being activated for a defined row addressing time and an operating current or a corresponding voltage being applied to the columns in correlation with the activated row corresponding to the desired brightness in the pixels;

wherein source data for the individual pixel brightnesses ($D_{ij}$) of the matrix display is decomposed into a plurality of matrices for driving the display, wherein the superposition of all the matrices generates the image of the matrix display or the part region of the matrix display at the desired brightness of the respective pixels; wherein the plurality of matrices includes one matrix for driving single lines of the display one or a plurality of matrices for driving multiple lines of the display simultaneously; and wherein an application-specific integrated circuit is provided which is configured to determine the row addressing time for each row variably as a function of the ratio of the maximum brightness.

* * * * *

UNITED STATES PATENT AND TRADEMARK OFFICE

CERTIFICATE OF CORRECTION

PATENT NO. : 8,456,493 B2
APPLICATION NO. : 12/163083
DATED : June 4, 2013
INVENTOR(S) : Xu et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 879 days.

Signed and Sealed this
Sixth Day of January, 2015

Michelle K. Lee

Michelle K. Lee
*Deputy Director of the United States Patent and Trademark Office*